US005676261A

United States Patent [19]

Baughman et al.

[11] Patent Number: 5,676,261

[45] Date of Patent: Oct. 14, 1997

[54] ROTATING FISHING ROD/POOL CUE HOLDER

[76] Inventors: Donald W. Baughman, 15 Ln 240A Big Otter Lk.; Arthur V. Baughman, 120 Ln. 140 Little Otter Lake, both of Fremont, Ind. 46737

[21] Appl. No.: 437,901

[22] Filed: May 8, 1995

[51] Int. Cl.[6] ..... A47F 7/00

[52] U.S. Cl. ..... 211/70; 211/68; 211/70.8; 211/163

[58] Field of Search ..... 211/70.8, 70, 70.2, 211/68, 163, 44, 78

[56] References Cited

U.S. PATENT DOCUMENTS

| | | | |
|---|---|---|---|
| 160,339 | 3/1875 | Ladd | 211/70 X |
| 561,243 | 6/1896 | Temple | 211/70 X |
| 663,838 | 12/1900 | White | 211/70 |
| 1,469,725 | 10/1923 | Helenek | 211/44 |
| 1,586,827 | 6/1926 | Michelbach | 211/70 |
| 3,826,378 | 7/1974 | Novak | 211/70 X |
| 4,738,038 | 4/1988 | Tanne et al. | 211/78 X |
| 4,753,446 | 6/1988 | Mills | 211/70.2 X |

*Primary Examiner*—Robert W. Gibson, Jr.
*Attorney, Agent, or Firm*—Ian C. McLeod; Mary M. Moyne

[57] ABSTRACT

The holder is designed to hold fishing rods, poles or pool cues for storage when transporting or when not in use. Our designed holder is free standing and basically consists of very few components. There are five major parts. First a foundation plate (14). This is the bottom plate of the holder. Second, a turntable assembly (18) that allows holder to rotate in a circular manner. Third, a base plate (24) that fastens to turntable assembly (18). The base plate (24) has a number of recesses (26) to support bottoms of stored items. Fourth, a rod or post (32) that is recessed into base plate (24) and top plate (34). Fifth, a top plate (34) that has the same number of recesses as base plate (24). Here the top ends of rods or cues are locked into place by a recess closure lock (42). Holder being upright in design with a larger foundation plate (14) than top plate (34) it will not fall over easily. To use and operate this holder is very simple. Place the bottom end of rod or cue into the base plate recess (26). Next lift the recess closure lock (42) from recess closure lock pin (46). Then place top of rod, pole or cue into aligned top plate recess (36). Close recess closure lock (42) down over closure pin (46). One item is now secure for storage or transporting repeat procedure for number of pieces to be stored by turning holder in either direction. To remove rods or cues reverse the procedure above. To transport holder grasp by rod (32) and carry to desired location. Being of light weight and free standing make this holder superior to all previous rod or cue holders. Our holder is of wood structure and holds eight items. But, as stated in the Summary, Ramifications and Scope, it can vary in structure, shape, and to number of pieces held.

7 Claims, 6 Drawing Sheets

ROTATING FISHING ROD/POOL CUE HOLDER

BACKGROUND-FIELD OF INVENTION

Figure 1:
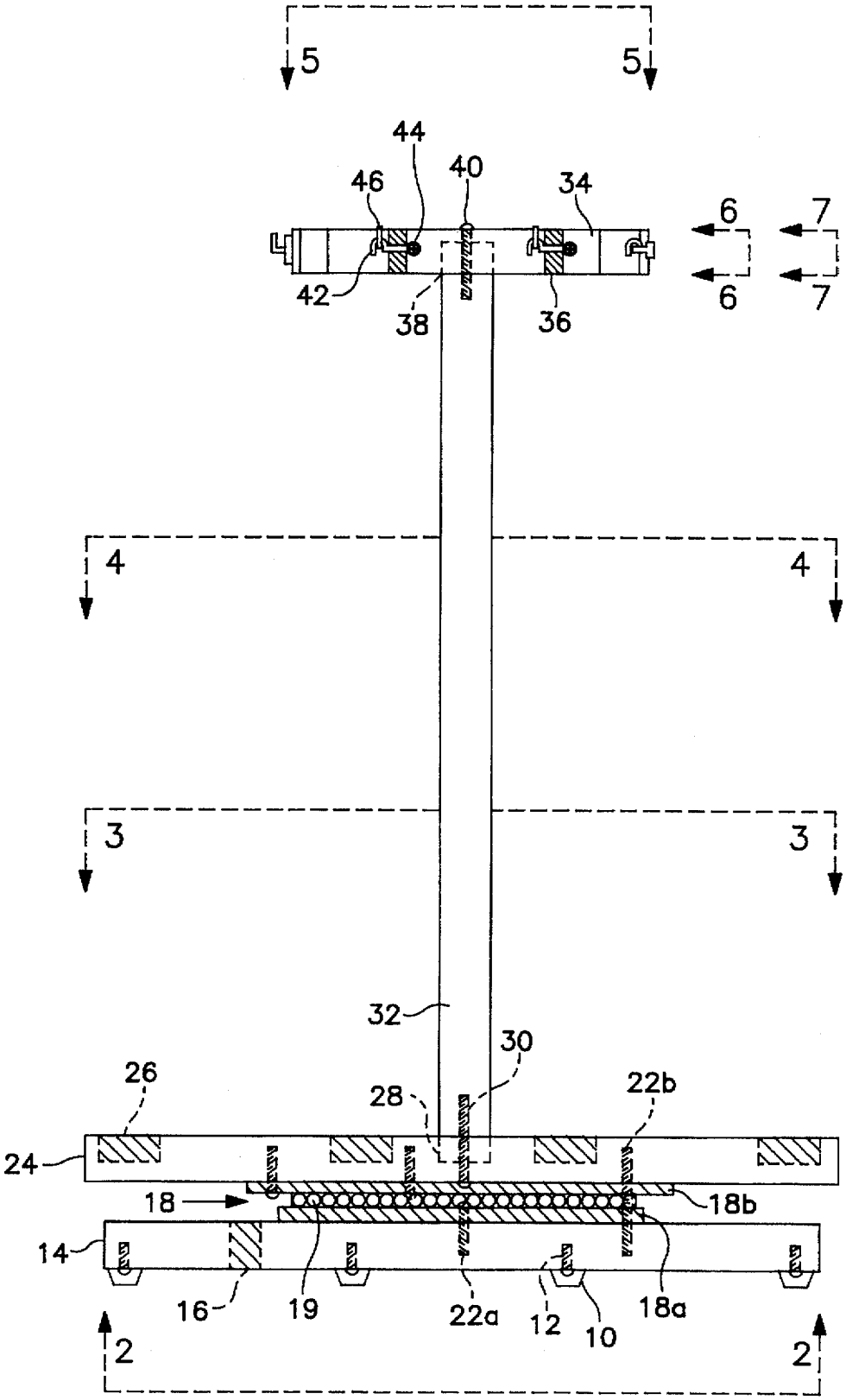

This invention relates to storage racks, specifically to racks which are designed to store fishing rods/poles or pool cues.

BACKGROUND-DESCRIPTION OF PRIOR ART

The owners of fishing rods/poles or pool cues desire to safely store and/or transport them when not in actual use. Thus, many different designs of storage or carrying racks have been developed and marketed.

This is particularly true for fishing rods/poles. One general design is that of a wall-mounted storage rack. Each red is separated and secured by some type of holding clamp. It provides safe storage, but requires labor and sufficient wall space for mounting. It also often means damaging walls by drilling holes for screws.

Furthermore, some wall mounts are, for all practical purposes, permanent. They cannot be easily transported between locations. Rigid mounts designed for the interiors of boats or motor vehicles have partially solved this problem. But there is still a need for installation labor, adequate space, and possible structural damage.

At least one design attempts to combine fixed storage with transportability. It can be initially mounted on a wall or floor. It can then be released and carried via a handle to another location and remounted. Nevertheless, more labor than is really necessary is required. In addition, this particular design requires one to carry a long rack in a horizontal position. It is awkward, and potentially damaging, to carry this through doorways or crowded rooms.

Floor model designs eliminate the need for mounting labor and sufficient wall slice. They are of two basic configurations. In-line desires store items upright, and slightly spaced apart, in a straight line. But these still occupy an unnecessarily large amount of space.

Some in-line designs store items by first wedging the bottom ends into a long, v-shaped trough, the upper ends are then set into recesses in a board running across the top. The items are not truly locked in place. They can slip out of position if the rack is moved.

The other basic floor model design has a circular, or square, or triangular, etc. base. These occupy less space than do in-line deserts. However, many of these sit on a fixed non-rotating base. It is awkward to retrieve or insert an item on the back side. The user must either walk around, reach around, or pick up and move the entire rack.

Some exist designs on a circular, square, etc. fixed base do rotate. But they have some of the disadvantages of the in-line design described above. Stored items are simply wedged in place at the bottom. At the top they are set in shallow, unlocked recesses. These rotating designs are also unduly complex, expensive, and more difficult to build.

One common design feature involves foam or hard rubber grips to securely hold stored items. The item is inserted into the grips'open end and held by simple friction. The grip must embrace the item and exert force against it. Long-stored items can cause these grips to take a permanent set. Each time an item is removed or inserted the grips can lose their flexibility and hence their effectiveness. Grips made of these materials can also tear out or dry out and crack.

Furthermore, these grips are commonly found on factory mass-produced examples of the prior art. They are not readily available to the average individual lay-builder. They might be difficult to find, expensive, and offer little selection of size and shape.

OBJECTIVE AND ADVANTAGES

Accordingly, several objects and advantages of our holder over the prior art are:

(a) to require no labor for mounting on a wall or interior, and be ready to use "as is";

(b) to allow placement in almost any room, boat, recreational vehicle, or even outdoors, thus avoiding the need for adequate wall space;

(c) to avoid the need to drill holes in a wall, or other necessary structural damage;

(d) to be far more transportable than fixed-position designs, including those rigidly mounted in a boat or vehicle;

(e) to be compact and lightweight enough to allow alternating between transport and fixed storage without mounting and dismounting;, (f) to be more floor space-efficient by employing a circular, square, etc. base which occupies less area than in-line designs;

(g) to store approximately the same number of items as many other floor model designs while occupying less floor space;

(h) to improve upon similar designs (without rotation) by rotating and allowing easier access to all stored items;

(i) to provide individual, locked storage recesses to more securely hold items;

(j) to use holding devices that are more durable and reliable than foam or hard rubber grips;

(k) to be of simple design, with relatively few, inexpensive, and readily available components, that the average lay-builder can build one.

The simplicity, economy, ease of manufacture, and reliability of our holder will become apparent from a consideration of the enclosed drawings and ensuing description.

DRAWING FIGURES

'FIG. 1' is a perspective side view of our holder.

Figure 2:
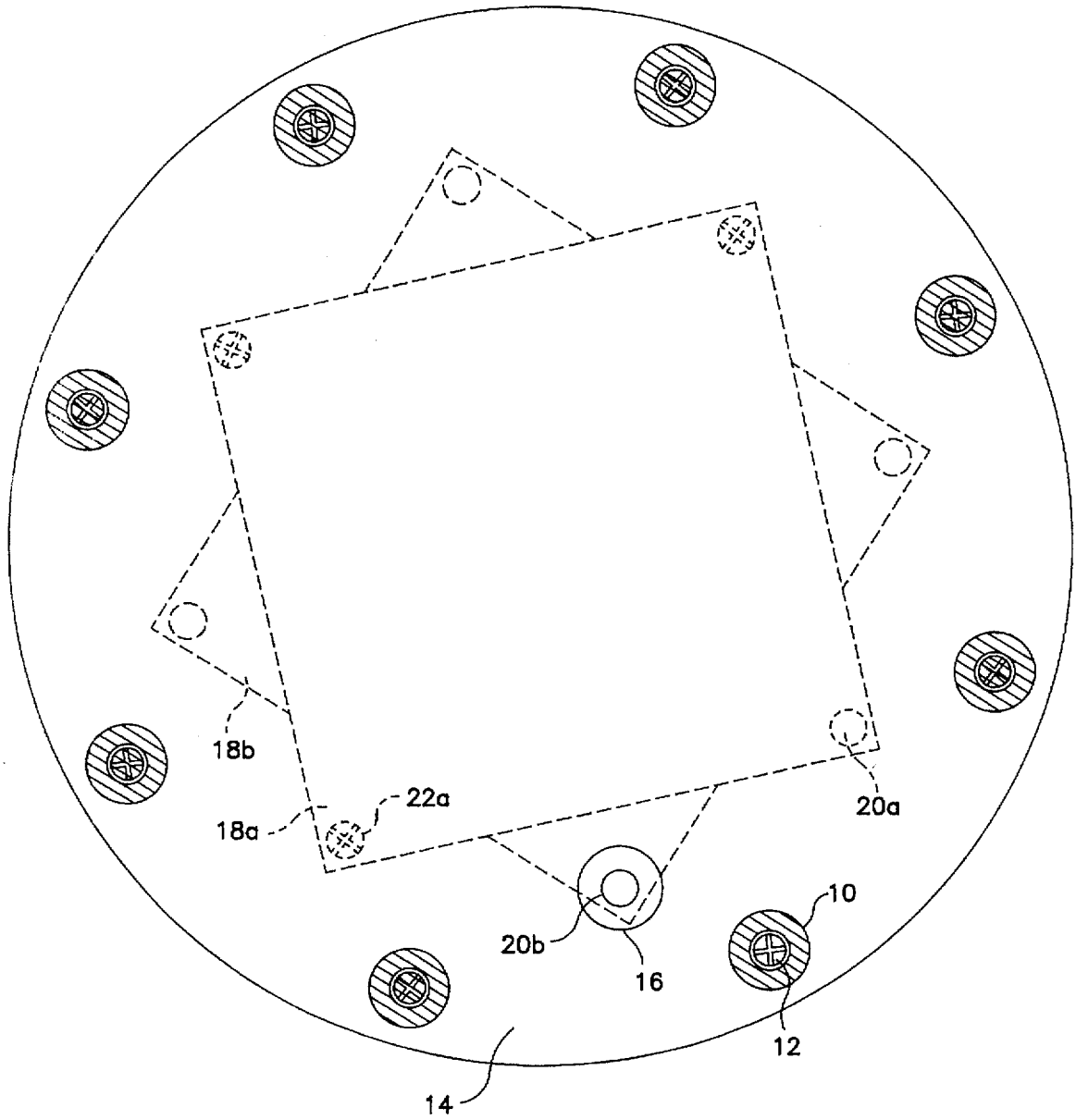

'FIG. 2' is an underside view of the portion indicated by the section lines 2—2 in 'FIG. 1'.

Figure 3:
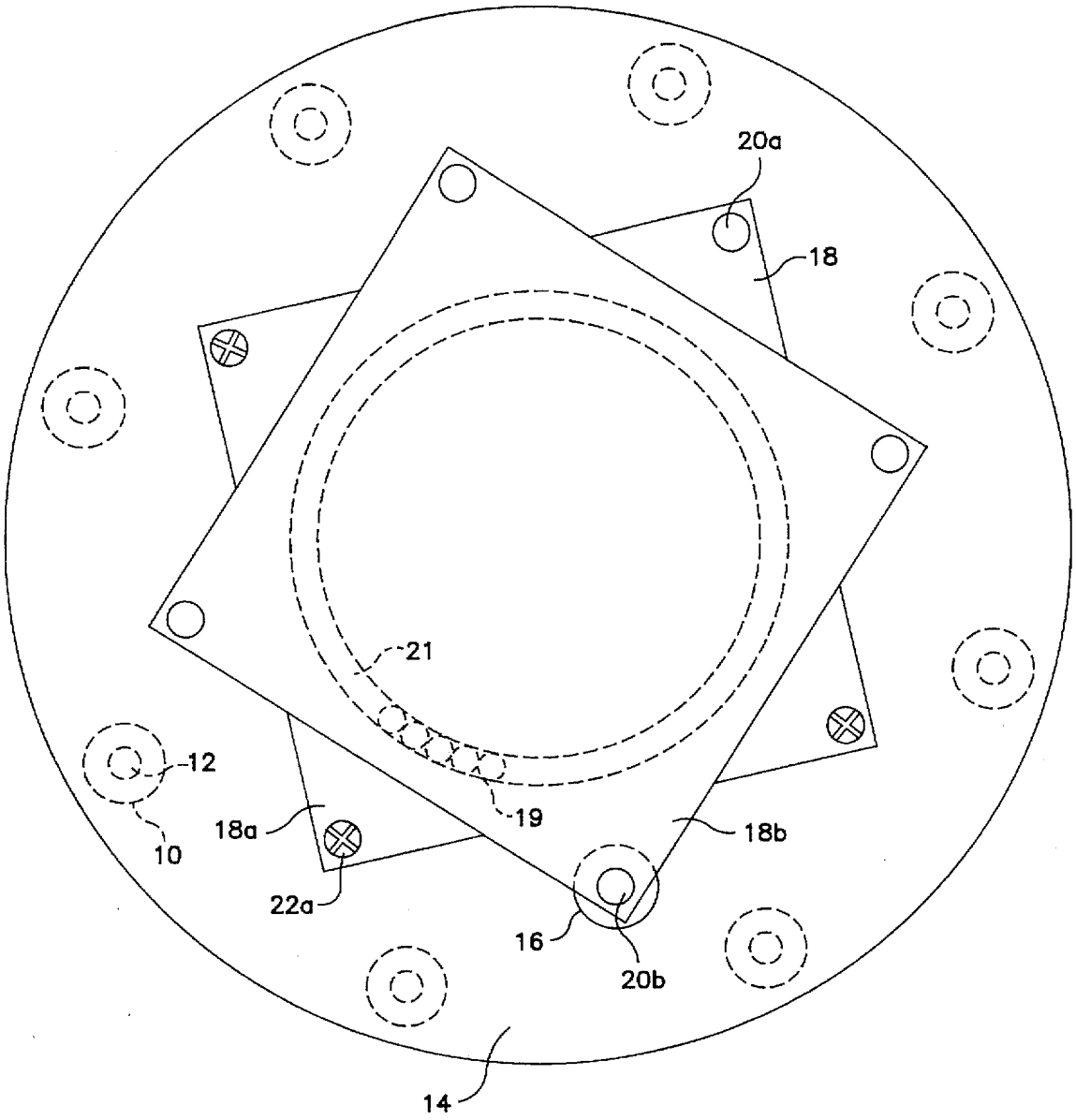

'FIG. 3' is a topside view of the portion indicated by the section lines 3—3, and by the reference number [14], in 'FIG. 1'.

Figure 4:
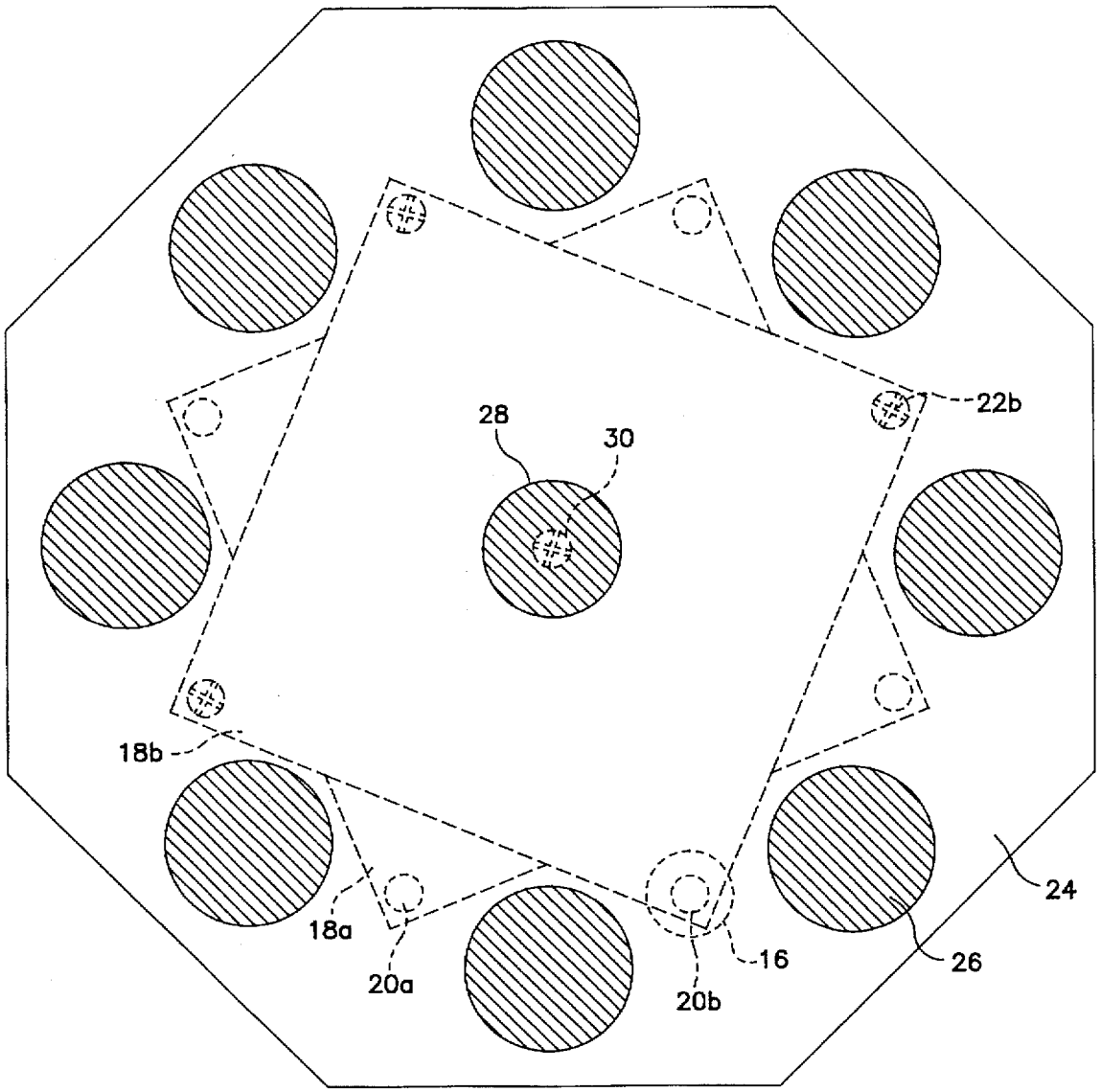

'FIG. 4' is a topside view of the portion indicated by the section lines 4—4, and by the reference number [24], in 'FIG. 1'.

Figure 5:
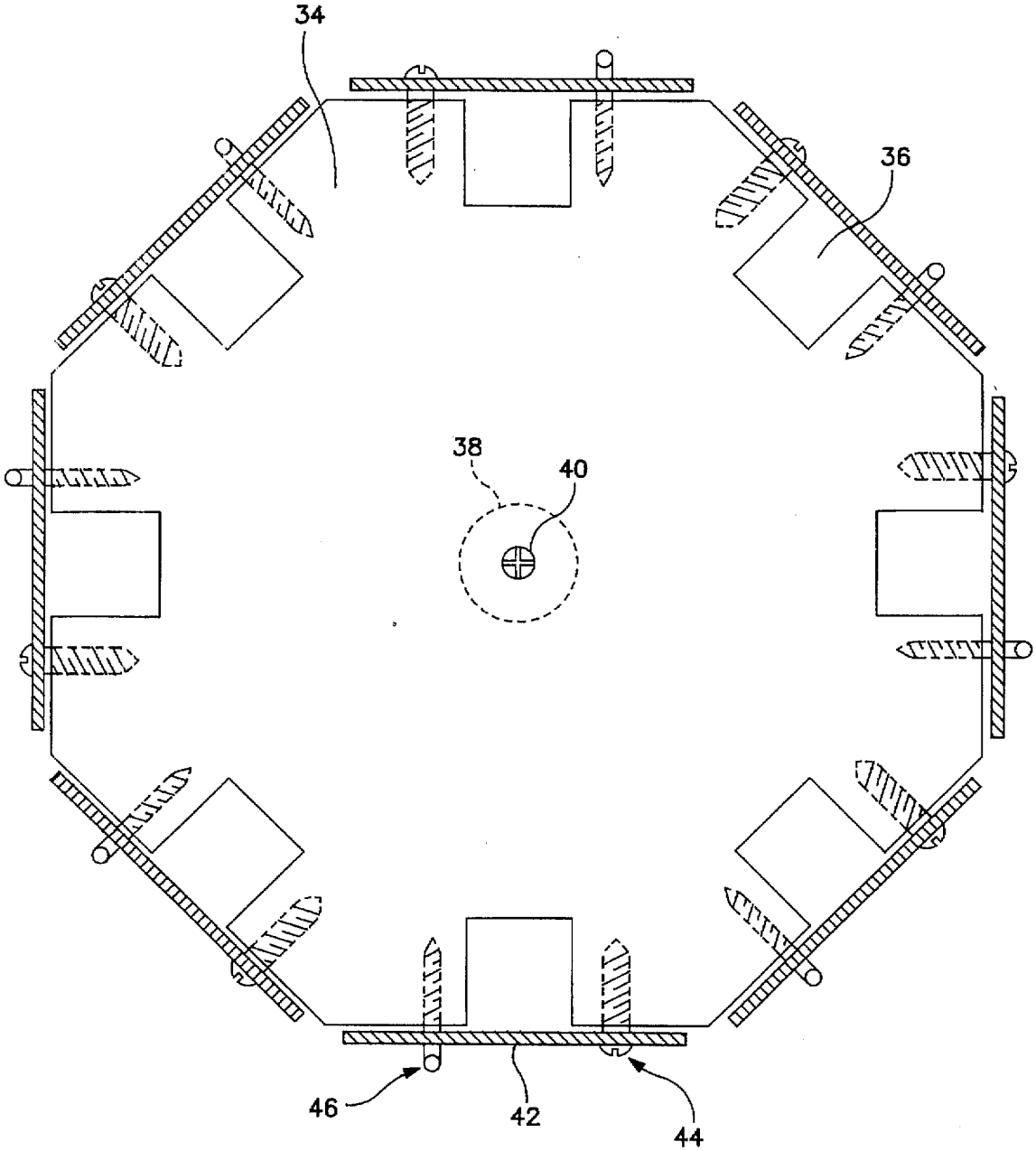

'FIG. 5' is a topside view of the portion indicated by the section lines 5—5 in 'FIG. 1'.

Figure 6:
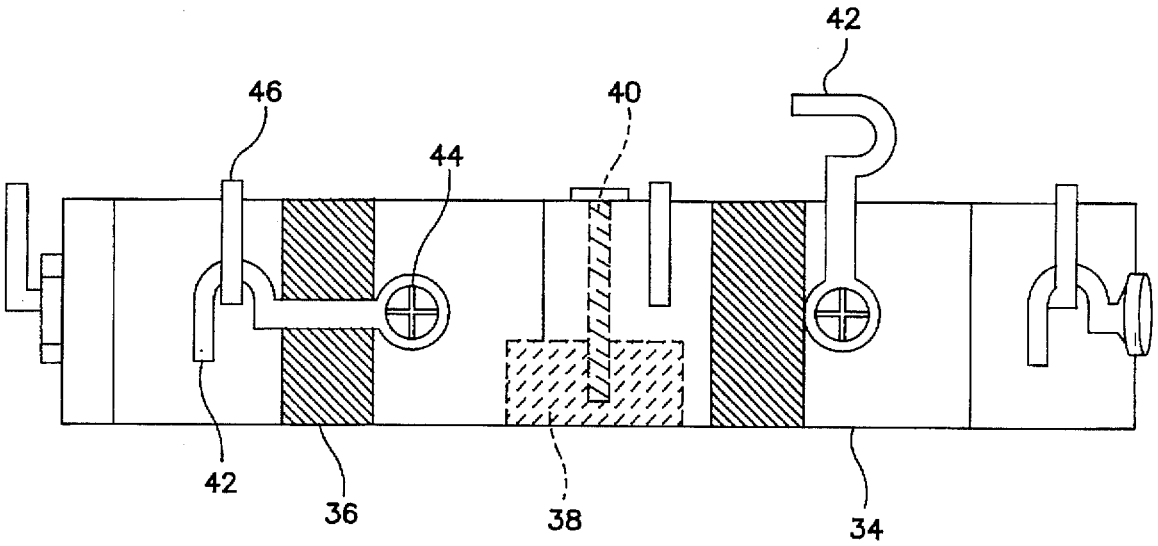

'FIG. 6' is a side view of the portion indicated by the section lines 6—6 in 'FIG. 1 '.

Figure 7:
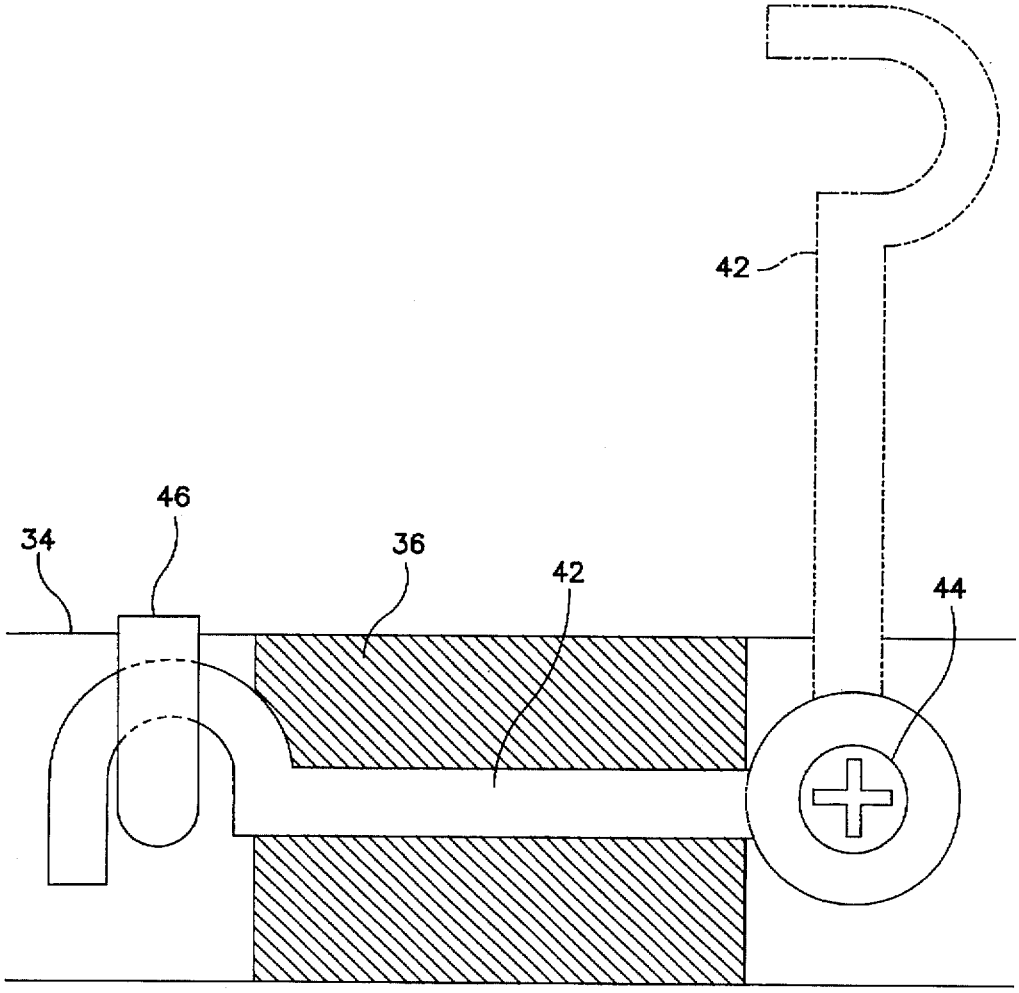

'FIG. 7' is a more detailed side view of the portion indicated by the section lines 7—7, and reference numbers [34]–[36], and [42]–[46], in 'FIG. 1'.

REFERENCE NUMBERS IN DRAWINGS

Similar components in drawings have the same number but different alphabetical suffixes:

| | |
|---|---|
| [10] | bumper pad |
| [12] | bumper pad screw |
| [14] | foundation plate |
| [16] | access hole |
| [18] | turntable assembly |
| [18a] | lower plate |
| [18b] | upper plate |
| [20a] | turntable lower plate hole |
| [20b] | turntable upper plate hole |
| [22a] | turntable lower plate screw |
| [22b] | turntable upper plate screw |
| [24] | base plate |
| [26] | base plate recess |
| [28] | base plate post recess |
| [30] | base plate post screw |
| [32] | post |
| [34] | top plate |
| [36] | top plate recess |
| [38] | top plate post recess |
| [40] | top plate post screw |
| [42] | recess closure lock |
| [44] | recess closure lock screw |
| [46] | recess closure lock pin |

DESCRIPTION OF DRAWING FIGURES

'FIG. 1' is a perspective side view of our holder. It shows the interconnections between components, major and minor, in the preferred embodiment.

There are five major components. At the bottom of 'FIG. 1' is a foundation plate or disk [14]. To its top-side is attached the second major component: a turntable assemble [18]. Turntable assembly [18] is also attached to the underside of the third major component: a base plate or disk [24]. Thus turntable assembly [18] connects foundation plate [14] and base plate [24].

The fourth major component, a post, pole, or shaft [32], rises from the center of base plate [24] in 'FIG. 1'. The top end of post [32] is attached to the fifth major component: a top plate or disk [34]. Thus post [32] connects top plate [34] to base plate [24], turntable assembly [18], and foundation plate [14].

Each component depicted in 'FIG. 1' is further detailed in 'FIGS. 2–7', in the preferred embodiment.

'FIG. 2' is an underside view of foundation plate [14]. Each of a series of bumper pads [10] is attached to the underside of foundation plate [14]. This attachment is made by a series of bumper pad screws, bolts, or pins [12]. Bumper pads [10] radiate an equal distance from the center of foundation plate [14]. They are equally spaced along the edge.

Shown as hidden parts in 'FIG. 2' are both halves of turntable assembly [18]. A lower plate [18*a*] is attached to the topside of foundation plate [14]. This attachment is via a series of lower plate screws, bolts, or pins [22*a*]. Each lower plate screw [22*a*] fits into a lower plate hole [20*a*]. A turntable upper plate [18*b*] is partially obscured by lower plate [18*a*] in this view. As better shown in 'FIG. 1', lower plate [18*a*] is beneath upper plate [18*b*].

'FIG.1 and 2' show an access hole [16] drilled completely through foundation plate [14]. Access hole [16] is precisely located. It must align with each of a series of turntable upper plate holes [20*b*] when upper plate [18*b*] is rotated. This alignment is shown in 'FIGS. 2 through 4'.

'FIG. 3' is a reverse angle view of 'FIG. 2' and details the topside of foundation plate [14]. Here upper plate [18*b*] is in full view and partially obscures lower plate [18*a*] beneath it. Lower plate [18*a*]is attached to foundation plate [14] via lower plate screws [22*a*] and holes [20*a*]. Access hole [16]is partially obscured by its alignment with one upper plate hole [20*b*]. Bumper pads [10] and screws [12] are shown as hidden parts.

'FIG. 1' shows base plate [24] to be above foundation plate [14]. In the center of base plate [24] is a base plate post recess or well [28]. This is bored down from the topside, but not completely through. A base plate post screw, bolt, or pin [30] enters base plate [24] from underneath. It also enters post recess [28] from underneath and bores into post [32]. Along the edge of base plate [24] is a series of base plate recesses or wells [26]. These are bored in a manner similar to post recess [28]. 'FIG. 4' is a topside view of these components. Post recess [28] and screw [30] are in the center of base plate [24]. Base plate recesses [26] radiate an equal distance from the center. They are equally spaced apart along the edge of base plate [24]. Lower plate [18*a*] and holes [20*a*] are shown as hidden parts. The same is true for upper plate [18*b*], holes [20b], and screws [22*b*]. The relative position of access hole [16] (from foundation plate 14) is also indicated. This is again to demonstrate the alignment of access hole [16] with an upper plate hole [20*b*].

As shown in 'FIG. 1', post [32] rises vertically from post recess [28] in base plate [24]. At its upper end, post[32] contacts top plate [34] at a top plate post recess or well [38]. A top plate post screw, bolt, or pin [40] enters top plate [34] from above. It also enters post recess [38] from above and bores into post [32].

In 'FIGS. 1, 5, and 6', evenly spaced along the side of top plate [34], is a series of top plate recesses or wells [36]. To one side of each is a recess closure lock screw, bolt, or pin [44]. On the other side is a recess closure lock pin [46]. In contact with both lock screw [44] and lock pin [46]is a recess closure lock [42]. This lays across the face of top plate recess [36].

'FIGS. 5, 6, and 7' offer close-up views of top plate [34]. 'FIG. 5' is a topside view. Hidden at the center is post recess [38] and screw [40]. Top plate recesses [36] radiate outward at equal distances from the center. They are cut into the side of top plate [34] and are equally spaced apart.

The number of top plate recesses [36] may vary. However, there should be one top plate recess [36] for every base plate recess [26]. Furthermore, each top plate recess [36] is aligned in the same vertical place as a base plate recess [26] below it.

'FIG. 5' again shows both a lock screw [44] and pin [46] flanking each top plate recess [36]. Both lock screw [44] and pin [46] are attached into the side of top plate [34]. The distance between lock screw [44] and pin [46] does not exceed the length of lock [42].

'FIG. 6' is a side view of top plate [34]. Post recess [38] and screw [40] are hidden. Lock [42] is shown in both lock (horizontal) and unlocked (vertical) configuration. The arrangement of each lock [42], lock screw [44], and pin [46] around each top plate recess [36] is clearly depicted.

'FIG. 7' is an even closer side view around each top plate recess [36]. Here, phantom lines illustrate that lock [42] is movable. It is again shown in locked (horizontal) and unlocked (vertical) configuration. Also shown again are lock screw [44] and pin [46].

The drawings and their descriptions above show our holder's simplicity, economy, and ease of manufacture.

(a) Relatively few components are needed. Only five major components (which are the most expensive) were illustrated. All other components are of far less cost and complexity.

(b) Little tooling labor or skill is needed. Essentially the most difficult operations are cutting and drilling. Most of these operations are repetitious. For example, each base plate recess [26] or top plate recess [36] in 'FIGS 4 or 5' can be drilled or cut without changing the tool set up between recesses.

(c) Tooling operations can be done using common, relatively inexpensive tools. Band saws and drill presses are preferred, but hand saws and hand drills may be used.

(d) There are approximately eighty-three (83) components in the preferred design embodiments illustrated. About seventy-three (73) components (88%) can be assembled together with only a screwdriver, pliers, and/or household glue.

(e) The components can be inexpensive and readily available to the average lay-builder. For example, wood is preferred for making four out of the five major components. Turntables, screws, and the locking mechanism components are commonly found at hardware and building supply stores.

(f) Manufacture requires no factory-like settings, assembly lines, or large labor force. It can be accomplished by one person working in his or her own home.

Operation of Holder

In the preferred embodiment, bumper pads [10] are cylindrical and made of hard rubber. They are hollow and open in the center. This allows bumper pad screws [12] to pass through easily for attachment to foundation plate [14].

Bumper pads [10] are evenly placed around the underside perimeter of foundation plate [14]. They hold the latter up off of the floor. Both floor and holder are protected from nicks and scratches. Bumper pads [10] also balance and cushion the holder.

Bumper pads [10] may be made of hard rubber, wood, metal, plastic, cork, etc. They may vary in shape-cylindrical, square, triangular, etc. They may vary in thickness and diameter, and may be either hollow or solid. Bumper pads [10] may alternately be replaced by a single piece of cushioning material. A sheet of the same materials listed above may be attached in a similar manner. It too may vary in thickness and diameter.

The preferred shape of foundation plate [14], as shown in 'FIGS. 2 and 3', is circular. It is best made of wood, and thick enough to be sturdy. It should have enough diameter to prevent the holder from tipping over.

Foundation plate [14] is a fixed base upon which the remaining structure above it may rotate. It may be made of wood, metal, plastic, fiberglass, or any other suitable material. It may be circular, square, triangular or any other suitable shape. It may vary in diameter and thickness.

'FIG. 1 through 4' show that turntable assembly [18] is attached to both foundation plate [14] and base plate [24]. Lower plate [18*a*] attaches to the topside of foundation plate [14]. This attachment is accomplished via lower plate screws [22*a*] through lower plate holes [20*a*]. Upper plate [18*b*] attaches to the underside of base plate [24]. Upper plate screws [22*b*] through upper plate holes [20*b*] accomplish this attachment.

Being attached to the fixed-position foundation plate [14], lower plate [18*a*] likewise remains fixed. Upper plate [18*b*] is capable of independent movement via ball bearings or rollers 19. It rotates on lower plate [18*a*]. Hence the remaining holder components, being interconnected to upper plate [18*b*], rotate as well.

Turntable assembly [18] should be metal, square in shape, and commercially built. It should consist of two halves, each capable of independent movement on ball bearings or rollers 19. Examples include those turntables commonly used in revolving chairs or "lazy susan" revolving food trays.

Turntable assembly [18] may, however, be made of wood, plastic, or fiberglass. It may be square, circular, triangular, or any other suitable shape. It may vary in diameter and thickness. Rotation may occur via ball bearings, rollers 19, wheels, on a track, or in a groove 21. There may be more than two independently moving plates.

Upper and lower plate screws [22*a*] and [22*b*], respectively, are preferably common wood screws. However, nails, tacks, bolts, rivets, or adhesive may be used instead.

Recall that access hole [16] is drilled completely through foundation plate [14]. It is best circular and slightly larger in diameter than upper plate holes [20*b*].

Also recall the attachment of upper plate [18*b*] to the underside of base plate [24]. As upper plate [18*b*] rotates, each upper plate hole [20*b*] aligns with access hole [16] (see 'FIGS. 2 through 4'. Thus the builder has access to each upper plate hole [20*b*] after partial assembly of the holder. An upper plate screw [22*b*] is first placed into access hole [16]. It is then pushed through base plate [24] and into an upper plate hole [20*b*]. New hole alignments continue until upper plate [18*b*] is secured to base plate [24].

Access hole [16] may be circular, square, or any other suitable shape. It should have enough diameter to give full access to upper plate holes [20*b*]. Adhesive might be used to attach turntable assembly [18] to foundation plate [14] and base plate [24]. Access hole [16] would then, of course, be unnecessary and could be omitted from the design.

'FIGS. 1 and 4' show the preferred embodiment of base plate [24], recesses [26], post recess [28], and screw [30]. Base plate [24] is best made of wood and thick enough to be sturdy. In 'FIG. 4', base plate [24] is octagon in shape. There are eight circular base plate recesses [26]. Post recess [28] is circular. Post screw [30] is best a common wood screw and longer than base plate [24] is thick. See 'FIG. 1'.

Base plate [24] is the floor on which the bottom ends of the stored items rest. Base plate recesses [26] are wells. The bottom ends of stored items are set into them and held securely. Post recess [28] is also a well. It receives and holds the bottom end of post [32]. Post recess [28], along with post screw [30], secures post[32] to base plate [24]. See 'FIG. 1'.

Base plate [24] may be made of wood, metal, plastic, or any other suitable material. It may be of various shapes (octagon, circular, etc.) and vary in thickness and diameter. Base plate recesses [26] may vary in number, shape, depth, and diameter. They should be slightly wider than the items set into them. Post recess [28] may also vary in shape, depth, and diameter. Post screw [30] may be replaced by a nail, tack, bolt, rivet, or adhesive.

Post [32] is best a round wooden dowel rod of sufficiently sturdy diameter. It should stand high enough so that top plate [34] will contact each stored item's upper half.

Post [32] elevates top plate [34], and connects the latter with base plate [24]. Both plates will thus rotate at the same time and in the same direction. Post [32] can also serve as a handle for rotating or carrying the holder.

Post [32] may be composed of wood, metal, plastic, or any other suitable material. It may be round, square, triangular, or any other suitable shape. Its height (length) may vary according to the length of the items to be stored. It may vary in diameter.

Top plate [34], best shown in 'FIGS. 1, 5, and 6', is best octagon-shaped and made of wood. It should be thick enough to be sturdy. It should have a diameter less than that of base plate [24]. Post recess [38] should be round. A common wood screw is preferred for post screw [40].

Top plate [34] is the foundation for the locking mechanisms described below. Post recess [38] and screw [40] attach top plate [34] to post [32]. Since post [32] is also attached to base plate [24], all of these components rotate together.

Top plate [34] may be made of wood, metal, plastic, or any other suitable material. It may be octagon, circular, square, or any other suitable shape. It may vary in thickness and diameter. It should have a smaller diameter than base plate [24]. Post recess [38] may very in shape, depth, and diameter. Post screw [40] may be replaced by a nail, tack, bolt, rivet, or adhesive.

Top plate recesses [36] are best square-shaped. They should be cut at least ½inch deep into top plate [34] (see 'FIG. 5'. Lock screw [44] should be a common wood screw. Lock pin [46] should be an L-shaped wood screw. A metallic hook, with an eyelet on the opposite end, works best for lock [42].

Top plate recesses [36] are the wells that receive and hold the stored items upper ends. They are closed off by locks [42], preventing the items from falling out. Lock screws [44] attach locks [42] to the side of top plate [34]. Lock screws [44] also allow locks [42] to hinge upward or downward. Lock pins [46] limit the movement of locks [42] (see 'FIG. 6 and 7'). When contacting, lock pins [46] and locks [42] are retained in a locked (horizontal) position.

To store an item (e.g. a spinning rod), its bottom end is first set into one base plate recess [26]. The upper end of the item is then pushed slowly toward top plate [34]. The user selects the appropriate top plate recess [36] and locking mechanism. This is in the same vertical plane as the base plate recess [26] being used. Initially, lock [42] is in a locked (horizontal) position (see 'FIG. 6'). It is then hinged upward on lock screw [44], to an unlocked (vertical) position ('FIGS. 6 and 7'). Top plate recess [36] is now open. Into it is placed the item's upper end. Lock [42] is hinged downward until it again contacts lock pin [46]. The latter prevents further downward or outward movement of lock [42]. Closure of top plate recess [36] is thus maintained, and the item is locked within. The procedure is repeated for each item to be stored. The procedure is reversed to remove each stored item.

Recall that the diameter of top plate [34] should be less than that of base plate [24]. When items are stored as described, they tend to lean forward toward post [32]. Thus gravity aids in keeping the items in position. See 'FIG. 1'.

Top plate recesses [36] may be square, triangular, half-moon, or any other suitable shape. They may vary in width and depth. However, they should be at least ½inch deep. They may vary in number, but should equal the number of base plate recesses [26]. Both types of recesses should be aligned in the same vertical place.

Lock [42] may be a hook, straight bar, or hinged door. Straps with hook and loop fasteners or snaps, or any other suitable mechanism, may be used. It may be composed of metal, wood, plastic, fabric, or any other suitable material. It may vary in length, width, and shape. It should be long enough to close off top plate recess [36] and contact both lock screw [44] and pin [46]. Lock screw [44] may be a screw, tack, nail; bolt, rivet, or adhesive. It could be replaced with another lock pin [46], and used with a straight-bar lock [42]. If so, lock [42] would not hinge, but would instead simply lift out. Lock pin [46] may be straight or bent. It could be replaced by a screw, nail, tack, bolt, snap, or hook and loop fastener. If lock [42] were a hinged steel door, lock pin [46] could be a magnet. Both lock screw [44] and pin [46]may be made of metal, wood, or any other suitable material. They may vary in size and shape.

SUMMARY, RAMIFICATIONS, AND SCOPE

The reader will see that the rotating rod/pool cue holder provides a simple but reliable means of storing a fishing rod, pole and/or pool cue stick. It allows one easy access to stored items by means of turning holder and raising closure hook from pin without having to pick up holder and turning it around to next item to be removed. Furthermore the holder has additional advantages in that it can be transported to another location where held items can be used. Also items do not have to be removed from holder to do this. It is inexpensive to build and being upright it takes up very little floor or wall space.

The above mentioned invention should not be limited to being made of any one said material. Wood is the chosen material but aluminum, plastic, fiberglass or any other accessible materials can be use. The number of bumper pads could vary and also could be made of any formed material. They may also vary in size and shape. The foundation plate, shown round, could be any other shape and also could vary in width and thickness. The access hole could vary in size and shape also. Various size turntable assemblies could be used, depending on width of foundation plate and base plates. The base plate also could vary in size and thickness or shape. The base plate recess may vary in shape, size, depth, and number. The rod may also vary in shape, size and length. The top plate may vary in size, shape and thickness. It may also vary to the number of top plate recesses. The top plate recesses could vary in shape, depth and number, but should equal the number of base plate recesses and be in alignment with base plate recesses. The closure lock is preferably a brass hook, but may vary in composition and configuration. The closure lock pin may vary in shape, length, and composition. The number of pins equals the number of locks. Screws are preferred with wood and may vary in shape of head and in length, but may be substituted with bolts, rivets or any other means of fastening. The above mentioned invention will catch peoples eye immediately once it is available to the public.

We claim:

1. A storage holder for holding stored items having opposed top and bottom ends comprising:

(a) a top plate, a foundation plate and a base plate oriented such that the top plate and foundation plate are spaced apart with the base plate spaced therebetween wherein the plates are stacked in a vertical direction;

(b) a vertical post interconnecting the top plate (c) locking mechanism means mounted on the top plate for positively securing against inadvertent slippage, of the bottom end of the stored item in the base plate and the top end of said stored item in the top plate; and (d) a turntable assemble having an upper plate and lower plate with rollers spaced therebetween, with the upper plate mounted on the base plate and the lower plate mounted on the foundation plate, wherein the turntable assembly provides a means for imparting equal rotational motion in the same circular direction, and at the same time, around a central axis, of the holder to the top plate and the base plate and to all said stored items secured within and wherein the lower plate and the foundation plate remain stationary while the upper plate, the top plate the base plate and the stored items rotate.

2. The storage holder of claim 1 wherein said foundation plate provides means for said storage holder to be free-standing and self-supporting in an upright orientation without need for external support via attachment to a wall or frame.

3. The storage holder of claim 1 wherein the base plate is mounted above said foundation plate, and provides means for the point of contact of said bottom ends of said stored items and supports the weight of said stored items.

4. The storage holder of claim 1 wherein a series of base plate recesses bored vertically into said base plate provide means of securing against slippage of said bottom ends of said stored items mounted into said recesses.

5. The storage holder of claim 6 wherein said top plate contains a series of top plate recesses bored horizontally into said top plate and providing means of securing against slippage of said top ends of said stored items mounted into said top plate recesses.

6. The storage holder of claim 5 wherein a locking mechanism means is attached to a side of said top plate and alternately lies across an open face of said top plate recess when said locking mechanism means is in a closed position, and parallel to said top plate recess when said locking mechanism means is in an open position.

7. The storage holder of claim 6 wherein said locking mechanism means, when in the closed position, provides additional means of securing against slippage of said top ends of said stored items from out of said top plate recesses.

* * * * *

UNITED STATES PATENT AND TRADEMARK OFFICE

CERTIFICATE OF CORRECTION

PATENT NO. : 5,676,261

DATED : October 14, 1997

INVENTOR(S) : Donald W. Baughman and Arthur V. Baughman

It is certified that error appears in the above-identified patent and that said Letters Patent is hereby corrected as shown below:

Column 1, line 15, "Each red" should be --Each rod--.

Column 1, line 36, "wall slice" should be --wall space--.

Column 1, line 37, "desires" should be --designs--.

Column 1, line 47, "deserts" should be --designs--.

Column 1, line 51, "exist designs" should be --existing designs--.

Column 6, line 20, a closed parenthesis --)-- should be inserted after "4' ".

Column 7, line 12, "very" should be --vary--.

Column 7, line 17, a closed parenthesis --)-- should be inserted after "Fig.5' ".

UNITED STATES PATENT AND TRADEMARK OFFICE

CERTIFICATE OF CORRECTION

PATENT NO. : 5,676,261

DATED : October 14, 1997

INVENTOR(S) : Donald W. Baughman and Arthur V. Baughman

It is certified that error appears in the above-identified patent and that said Letters Patent is hereby corrected as shown below:

Column 8, line 51 (Claim 1(b)), after "plate", --and the base plate-- should be inserted.

Column 8, line 56 (Claim 1(d)), "assemble" should be --assembly--.

Column 9, line 14 (Claim 5), "Claim 6" should be --Claim 1-.

Signed and Sealed this

Tenth Day of February, 1998

Bruce Lehman

*Attest:*

BRUCE LEHMAN

*Attesting Officer*

*Commissioner of Patents and Trademarks*